US009795162B2

(12) United States Patent
Sur

(10) Patent No.: US 9,795,162 B2
(45) Date of Patent: Oct. 24, 2017

(54) SYSTEM FOR MONITORING ENVIRONMENTAL CONDITIONS OF A TOBACCO CURING SITE

(71) Applicant: R. J. Reynolds Tobacco Company, Winston-Salem, NC (US)

(72) Inventor: Rajesh Sur, Winston-Salem, NC (US)

(73) Assignee: R. J. REYNOLDS TOBACCO COMPANY, Winston Salem, NC (US)

( * ) Notice: Subject to any disclaimer, the term of this patent is extended or adjusted under 35 U.S.C. 154(b) by 0 days.

(21) Appl. No.: 15/018,342

(22) Filed: Feb. 8, 2016

(65) Prior Publication Data

US 2017/0224007 A1 Aug. 10, 2017

(51) Int. Cl.
*F26B 21/02* (2006.01)
*A24B 3/12* (2006.01)
*F26B 25/16* (2006.01)

(52) U.S. Cl.
CPC ..... *A24B 3/12* (2013.01); *F26B 21/02* (2013.01); *F26B 25/16* (2013.01)

(58) Field of Classification Search
CPC ..... F26B 21/02; F26B 25/16; A24B 3/12
USPC ..... 34/518; 131/121; 432/290
See application file for complete search history.

(56) References Cited

U.S. PATENT DOCUMENTS 646,218 A * 3/1900 Hollingsworth ..... A24B 3/04 131/302
1,547,958 A 7/1925 Ring
1,853,423 A * 4/1932 Harris ..... A24B 3/04 131/303
2,082,289 A 6/1937 Hodgin
2,105,848 A * 1/1938 Touton ..... A24B 3/04 131/302
2,134,843 A 11/1938 Rouse
2,343,345 A * 3/1944 Touton ..... A24B 1/02 131/303
2,474,534 A 6/1949 Hugh
2,475,568 A 7/1949 Moore, Jr.
3,110,326 A 11/1963 Hassler
3,134,583 A 5/1964 Wilson
3,244,445 A 4/1966 Wilson
3,251,620 A 5/1966 Hassler
(Continued)

FOREIGN PATENT DOCUMENTS

BR EP 2949838 A1 * 12/2015 ..... E04H 5/08
CA 1026186 A 2/1978
GB WO 2014115028 A1 * 7/2014 ..... E04H 5/08

*Primary Examiner* — Stephen M Gravini
(74) *Attorney, Agent, or Firm* — Womble Carlyle Sandridge & Rice, LLP

(57) ABSTRACT

A system for monitoring environmental conditions of a tobacco curing site within which tobacco is cured is provided. A power supply of the system may include a supercapacitor configured to provide power, and a photovoltaic cell connected to and from which the supercapacitor may be chargeable. A temperature and humidity sensor may be positioned proximate the tobacco curing site and configured to measure a temperature or humidity within the tobacco curing site, and generate a signal corresponding to the temperature or humidity so measured. A local control unit may have a distal position relative the tobacco and be configured to receive the signal, and generate corresponding measurement data, and wirelessly transmit the corresponding measurement data to a remote control unit configured for display or analysis.

20 Claims, 5 Drawing Sheets

(56) References Cited

U.S. PATENT DOCUMENTS 3,450,192 A * 6/1969 Hay ..... F24F 5/00 126/628
3,503,137 A 3/1970 Wilson
3,664,034 A 5/1972 Wilson
3,669,429 A 6/1972 Dew
3,866,334 A * 2/1975 Huang ..... A24B 1/02 126/629
3,935,648 A * 2/1976 Cox ..... A24B 1/02 131/300
3,937,227 A * 2/1976 Azumano ..... A24B 1/02 131/302
4,011,041 A 3/1977 Taylor
4,021,928 A * 5/1977 Johnson ..... A24B 1/02 131/302
4,069,593 A * 1/1978 Huang ..... F26B 3/286 126/617
4,114,288 A 9/1978 Fowler
4,192,323 A * 3/1980 Horne ..... A24B 1/02 131/303
4,206,554 A 6/1980 Fowler
4,247,992 A 2/1981 MacGregor
4,267,645 A 5/1981 Hill
4,424,024 A 1/1984 Wilson et al.
4,470,422 A * 9/1984 Joubert ..... A24B 1/02 131/302
4,499,911 A 2/1985 Johnson
5,431,175 A * 7/1995 Beckett ..... F26B 21/08 131/300
5,685,710 A 11/1997 Martinez Sagrera et al.
6,202,649 B1 3/2001 Williams
6,786,220 B2 * 9/2004 Bokelman ..... A24B 1/02 131/300
6,846,177 B1 * 1/2005 Hutchens ..... A24B 1/02 131/290
7,025,066 B2 4/2006 Lawson et al.
7,293,564 B2 11/2007 Perfetti et al.
7,404,406 B2 7/2008 Peele
7,503,330 B2 3/2009 Borschke et al.
7,624,740 B2 * 12/2009 Lipscomb ..... A24B 1/02 131/303
7,650,892 B1 1/2010 Groves et al.
7,726,320 B2 6/2010 Robinson et al.
7,798,153 B2 9/2010 Lawrence, Jr.
8,151,804 B2 4/2012 Williams
8,800,571 B2 * 8/2014 Borschke ..... A24B 1/02 131/302
8,881,737 B2 * 11/2014 Collett ..... A24F 47/008 128/202.21
9,016,285 B2 * 4/2015 Riddick ..... A24B 3/12 131/302
9,066,538 B2 6/2015 Chen et al.
9,204,667 B2 12/2015 Cantrell et al.
2008/0245377 A1 10/2008 Marshall et al.
2011/0259353 A1 10/2011 Coleman, III et al.
2015/0189908 A1 * 7/2015 Riddick ..... A24B 3/04 131/303
2015/0223522 A1 8/2015 Ampolini et al.
2015/0366261 A1 12/2015 Mocelin et al.
2017/0055565 A1 * 3/2017 Riddick ..... A24B 15/18

* cited by examiner

SYSTEM FOR MONITORING ENVIRONMENTAL CONDITIONS OF A TOBACCO CURING SITE

TECHNOLOGICAL FIELD

The present disclosure relates to products made or derived from tobacco, or that otherwise incorporate tobacco, and are intended for human consumption. Of particular interest are systems and methods for monitoring environmental conditions of curing sites for obtaining or deriving ingredients or components from tobacco plants or portions of plants from the *Nicotiana* species which may be cured and otherwise configured for use in oral-use or smokable tobacco products.

BACKGROUND

Cigarettes, cigars and pipes are popular smoking articles that employ tobacco in various forms. Such smoking articles are used by heating or burning tobacco, and aerosol (e.g., smoke) is inhaled by the smoker. Tobacco also may be enjoyed in a so-called "smokeless" form. Particularly popular smokeless tobacco products are employed by inserting some form of processed tobacco or tobacco-containing formulation into the mouth of the user. More recently, popular so-called "electronic cigarettes" employ electrically generated heat to provide vapors incorporating tobacco components for inhalation. See, for example, those types of tobacco products described in the background art set forth in U.S. Pat. No. 7,503,330 to Borschke et al.; U.S. Pat. No. 7,726,320 to Robinson et al. and U.S. Pat. No. 9,204,667 to Cantrell et al.; and US Pat. Pub. No. 2015/0223522 to Ampolini et al., which are incorporated herein by reference.

Tobacco that has been grown and harvested is subjected to curing and aging processes prior to being used for the production of tobacco products. Various traditional types of curing and aging processes are described in Tobacco Production, Chemistry and Technology, Davis et al. (Eds.) p. 346 (1999). Of particular interest within the tobacco industry are curing processes that are characterized as being air curing, flue curing or fire curing processes. See, for example, those types of curing processes, methodologies and techniques proposed in U.S. Pat. No. 7,404,406 to Peele; U.S. Pat. No. 7,650,892 to Groves et al.; U.S. Pat. No. 8,800,571 to Borschke et al. and U.S. Pat. No. 9,016,285 to Riddick; Nestor et al., Beitrage Tabakforsch. Int., 20, 467-475 (2003); Roton et al., Beitrage Tabakforsch. Int., 21, 305-320 (2005) and Staaf et al., Beitrage Tabakforsch. Int., 21, 321-330 (2005), which are incorporated herein by reference. See, also, those types of curing processes proposed in U.S. Pat. No. 7,293,564 to Perfetti et al., U.S. Pat. No. 9,066,538 to Chen et al., and US Pat. Pub. No. 2015/0366261 to Mocelin et al.; which are incorporated herein by reference.

The types of processes and conditions required for tobacco curing may vary, and include air curing, flue curing, fire curing, and other curing processes. It would be desirable to provide systems and methods for monitoring the environmental conditions of tobacco curing sites within which tobacco may be cured.

BRIEF SUMMARY

The present disclosure relates to tobacco curing sites within which tobacco may be cured, and systems and methods for monitoring the environmental conditions thereof. The present disclosure thus includes, without limitation, the following example implementations. In some example implementations, a tobacco curing site is provided. The tobacco curing site may comprise a housing, a plurality of laths contained within the housing and configured to carry tobacco, a curing mechanism contained within the housing and configured to cure the tobacco carried by the plurality of laths, and a system for monitoring an environmental condition of the tobacco.

The system may comprise a temperature and humidity sensor contained within the housing, positioned proximate the tobacco, and configured to measure a temperature or humidity of an environment within the housing as the tobacco is cured. The temperature and humidity sensor may configured to generate a signal corresponding to the temperature or humidity so measured. The system may also comprise a power supply including a supercapacitor configured to provide power, and a photovoltaic cell connected to and from which the supercapacitor is chargeable. The system may also comprise a local control unit having a distal position relative to the tobacco, operatively coupled to the temperature and humidity sensor, and powered by power supply. The local control unit may be configured to receive the signal from the temperature and humidity sensor, and wirelessly transmit corresponding measurement data to a remote control unit for display or analysis.

In some example implementations of the tobacco curing site of the preceding or any subsequent example implementation, or any combination thereof, the curing mechanism includes at least one of an air-curing mechanism, fire-curing mechanism, or flue-curing mechanism.

In some example implementations of the tobacco curing site of any preceding or any subsequent example implementation, or any combination thereof, the housing includes a pitched roof, and the temperature and humidity sensor is positioned between an eave and peak thereof.

In some example implementations of the tobacco curing site of any preceding or any subsequent example implementation, or any combination thereof, the power supply further includes a secondary power source configured to provide power, and the local control unit is switchably powered by the supercapacitor or secondary power source.

In some example implementations of the tobacco curing site of any preceding or any subsequent example implementation, or any combination thereof, the local control unit is rated at a maximum operating temperature that is less than a temperature at which the tobacco is cured.

In some example implementations of the tobacco curing site of any preceding or any subsequent example implementation, or any combination thereof, the power supply further includes a DC-to-DC converter connected to the supercapacitor, between the supercapacitor and local control unit, and configured to regulate a discharge current from the power supply to the local control unit.

In some example implementations of the tobacco curing site of any preceding or any subsequent example implementation, or any combination thereof, the local control unit has an active mode and an inactive mode, and the system further comprises a power supply timer operatively coupled to the power supply and configured to decrease a current discharge rate thereof when the local control unit is in the inactive mode, in at least one instance the inactive mode being triggered by the temperature so measured being below a predefined threshold.

In some example implementations of the tobacco curing site of any preceding or any subsequent example implementation, or any combination thereof, the local control unit is configured to wirelessly transmit the corresponding measurement data to the remote control unit configured to generate a log including the measurement data.

In some example implementations of the tobacco curing site of any preceding or any subsequent example implementation, or any combination thereof, the local control unit is configured to wirelessly transmit the corresponding measurement data to the remote control unit configured to timestamp each instance of the corresponding measurement data, and store the log including the timestamped measurement data in a local memory of the remote control unit, or in remote data storage communicably coupled to the remote control unit.

In some example implementations of the tobacco curing site of any preceding or any subsequent example implementation, or any combination thereof, the local control unit is configured to wirelessly transmit the corresponding measurement data to the remote control unit configured to generate an alert in at least one instance in which the corresponding measurement data indicates that the temperature or humidity is outside a predefined specification of the curing site.

In some example implementations of the tobacco curing site of any preceding or any subsequent example implementation, or any combination thereof, the system further comprises an alarm, and the local control unit is configured to receive the alert from the remote control unit, and activate the alarm in response thereto.

In some example implementations, a system is provided for monitoring environmental conditions of a tobacco curing site within which tobacco is cured. The system may comprise a power supply including a supercapacitor configured to provide power, and a photovoltaic cell connected to and from which the supercapacitor is chargeable. The system may also comprise a temperature and humidity sensor contained within the tobacco curing site, positioned proximate the tobacco, and configured to measure a temperature or humidity of an environment within the tobacco curing site as the tobacco is cured. The temperature and humidity sensor may be configured to generate a signal corresponding to the temperature or humidity so measured. The system may also comprise a local control unit having a distal position relative to the tobacco, operatively coupled to the temperature and humidity sensor, and powered by power supply. The local control unit may be configured to receive the signal from the temperature and humidity sensor, and wirelessly transmit corresponding measurement data to a remote control unit for display or analysis.

In some example implementations of the system of the preceding or any subsequent example implementation, or any combination thereof, the power supply further includes a secondary power source configured to provide power, and the local control unit is switchably powered by the supercapacitor or secondary power source.

In some example implementations of the system of any preceding or any subsequent example implementation, or any combination thereof, the local control unit is rated at a maximum operating temperature that is less than a temperature at which the tobacco is cured.

In some example implementations of the system of any preceding or any subsequent example implementation, or any combination thereof, the power supply further includes a DC-to-DC converter connected to the supercapacitor, between the supercapacitor and local control unit, and configured to regulate a discharge current from the power supply to the local control unit.

In some example implementations of the system of any preceding or any subsequent example implementation, or any combination thereof, the local control unit has an active mode and an inactive mode, and the system further comprises a power supply timer operatively coupled to the power supply and configured to decrease a current discharge rate thereof when the local control unit is in the inactive mode, in at least one instance the inactive mode being triggered by the temperature so measured being below a predefined threshold.

In some example implementations of the system of any preceding or any subsequent example implementation, or any combination thereof, the local control unit is configured to wirelessly transmit the corresponding measurement data to the remote control unit configured to generate a log including the measurement data.

In some example implementations of the system of any preceding or any subsequent example implementation, or any combination thereof, the local control unit is configured to wirelessly transmit the corresponding measurement data to the remote control unit configured to timestamp each instance of the corresponding measurement data, and store the log including the timestamped measurement data in a local memory of the remote control unit, or in remote data storage communicably coupled to the remote control unit.

In some example implementations of the system of any preceding or any subsequent example implementation, or any combination thereof, the local control unit is configured to wirelessly transmit the corresponding measurement data to the remote control unit configured to generate an alert in at least one instance in which the corresponding measurement data indicates that the temperature or humidity is outside a predefined specification of the curing site.

In some example implementations of the system of any preceding or any subsequent example implementation, or any combination thereof, the system further comprises an alarm, and the local control unit is configured to receive the corresponding alert from the remote control unit, and activate the alarm in response thereto.

These and other features, aspects, and advantages of the present disclosure will be apparent from a reading of the following detailed description together with the accompanying drawings, which are briefly described below. The present disclosure includes any combination of two, three, four or more features or elements set forth in this disclosure, regardless of whether such features or elements are expressly combined or otherwise recited in a specific example implementation described herein. This disclosure is intended to be read holistically such that any separable features or elements of the disclosure, in any of its aspects and example implementations, should be viewed as intended, namely to be combinable, unless the context of the disclosure clearly dictates otherwise.

It will therefore be appreciated that this Brief Summary is provided merely for purposes of summarizing some example implementations so as to provide a basic understanding of some aspects of the disclosure. Accordingly, it will be appreciated that the above described example implementations are merely examples and should not be construed to narrow the scope or spirit of the disclosure in any way. Other example implementations, aspects and advantages will become apparent from the following detailed description taken in conjunction with the accompanying drawings which illustrate, by way of example, the principles of some described example implementations.

BRIEF DESCRIPTION OF THE DRAWING(S)

Having thus described the disclosure in the foregoing general terms, reference will now be made to the accompanying drawings, which are not necessarily drawn to scale, and wherein:

DETAILED DESCRIPTION

Figure 1A:
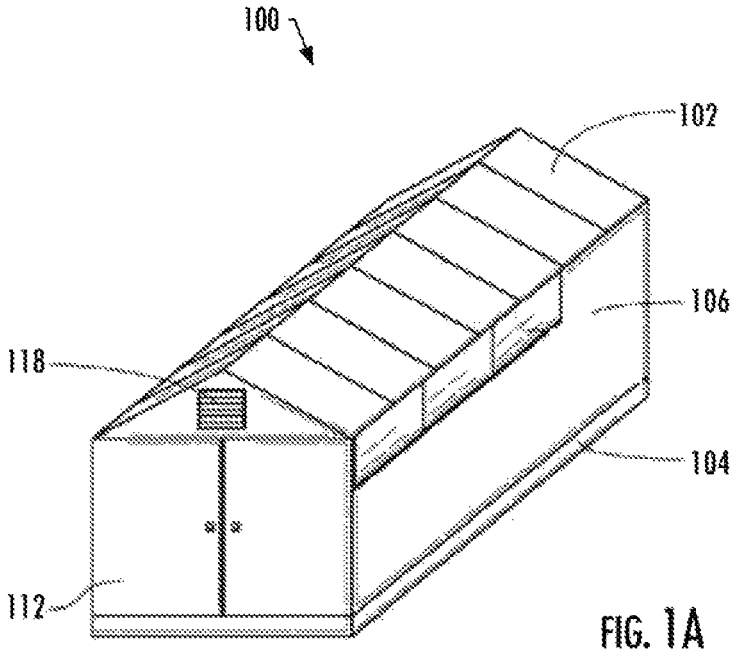
FIGS. 1A, 1B and 1C illustrate a tobacco curing site according to an example implementation of the present disclosure.

The present disclosure will now be described more fully hereinafter with reference to example implementations thereof. These example implementations are described so that this disclosure will be thorough and complete, and will fully convey the scope of the disclosure to those skilled in the art. Indeed, the disclosure may be embodied in many different forms and should not be construed as limited to the implementations set forth herein; rather, these implementations are provided so that this disclosure will satisfy applicable legal requirements. As used in the specification and the appended claims, the singular forms "a," "an," "the" and the like include plural referents unless the context clearly dictates otherwise.

The plants or portions of plants from the *Nicotiana* species that are processed in accordance with the present invention can vary. Various types of tobaccos are set forth in U.S. Pat. No. 7,025,066 to Lawson et al.; U.S. Pat. No. 7,798,153 to Lawrence, Jr.; and US Patent Appl. Pub. Nos. 2008/0245377 to Marshall et al. and 2011/0259353 to Coleman III et al.; each of which is incorporated herein by reference. Of particular interest are tobaccos that are subjected to the application of heat or air during curing, such as tobaccos that are subjected to so-called flue-curing, fire-curing, or air-curing process steps.

A tobacco curing site may be or include a curing barn used to apply heat or air to tobacco and hence provide cured tobaccos. A curing barn may be commonly equipped with a heating or air source, such as an indirect heating source (e.g., an electrical heating unit, or a propane or diesel powered heat exchange unit). A common curing barn may also be equipped with a fan for circulating air within the barn, and manual or automated temperature and humidity controls. Exemplary curing barns and methods for curing tobacco using those barns are of the type described in U.S. Pat. No. 1,547,958 to Ring; U.S. Pat. No. 2,082,289 to Hodgin; U.S. Pat. No. 2,134,843 to Rouse; U.S. Pat. No. 2,474,534 to Hugh; U.S. Pat. No. 2,475,568 to Moore, Jr.; U.S. Pat. No. 3,110,326 to Hassler; U.S. Pat. No. 3,134,583 to Wilson; U.S. Pat. No. 3,244,445 to Wilson; U.S. Pat. No. 3,251,620 to Hassler; U.S. Pat. No. 3,503,137 to Wilson; U.S. Pat. No. 3,664,034 to Wilson; U.S. Pat. No. 3,669,429 to Dew; U.S. Pat. No. 3,937,227 to Azumano; U.S. Pat. No. 4,011,041 to Taylor; U.S. Pat. No. 4,021,928 to Johnson; U.S. Pat. No. 4,114,288 to Fowler; U.S. Pat. No. 4,192,323 to Home; U.S. Pat. No. 4,206,554 to Fowler; U.S. Pat. No. 4,247,992 to MacGregor; U.S. Pat. No. 4,267,645 to Hill; U.S. Pat. No. 4,424,024 to Wilson et al. U.S. Pat. No. 4,499,911 to Johnson; U.S. Pat. No. 5,685,710 to Martinez Sagrera et al.; U.S. Pat. No. 6,202,649 to Williams; U.S. Pat. No. 7,293,564 to Perfetti et al. and U.S. Pat. No. 7,404,406 to Peele; and Canadian Patent No. 1,026,186; which are incorporated herein by reference.

In North America, and particularly in the U.S.A., tobacco curing barns have been manufactured and supplied by various companies, including Long Manufacturing Inc., Taylor Manufacturing Company, Powell Manufacturing Company, Tharrington Industries, and DeCloet Ltd. Other curing barns are available throughout the world, and exemplary barns may be provided by Vencon-Varsos S.A. of Greece (e.g., tobacco curing systems marketed as Vento-bacco Curing Units). Tobacco curing barns have been manufactured and operated in traditional manners for many years, and the design, manufacture and use of such barns will be readily apparent to those skilled in the art of tobacco curing.

Figure 1B:
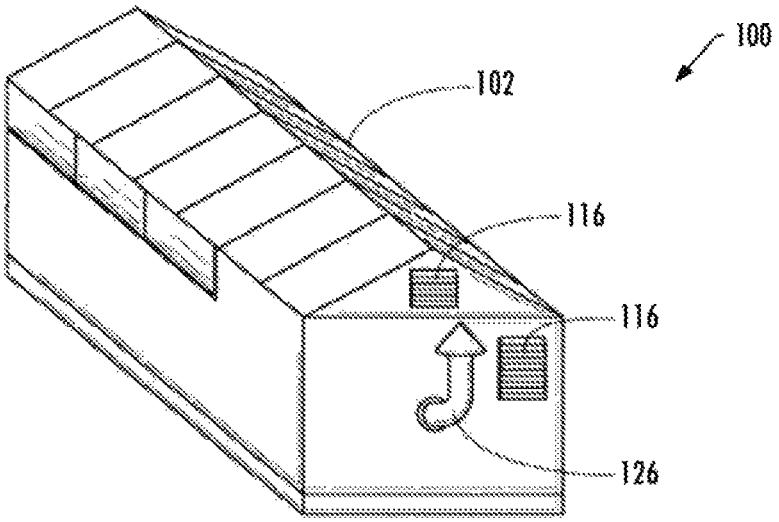
Figure 1C:
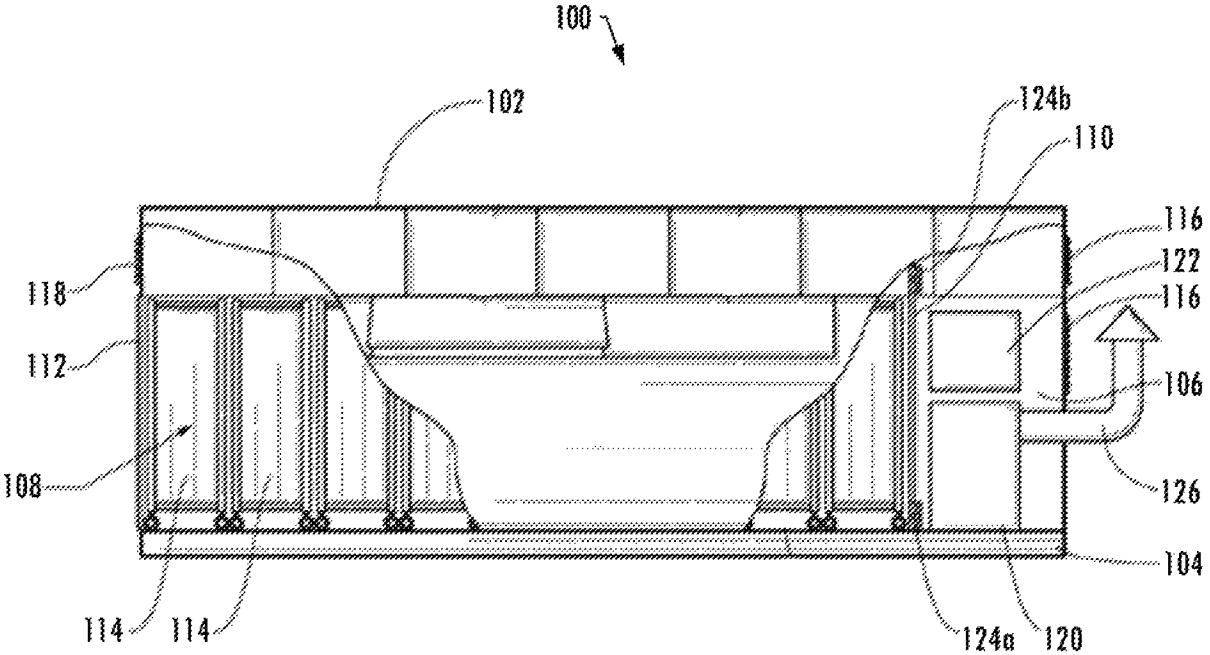

FIGS. 1A, 1B and 1C illustrate a tobacco curing site 100 according to examples implementations of the present disclosure. As shown, the curing site may be or include a curing barn (e.g., flue-curing barn) comprising a roof 102, four walls and a foundation 104. It should be noted that although the illustrated implementations are discussed with the respect to a flue-curing barn, the present invention may be used in conjunction with one or more alternative curing barns such as an air-curing barn or fire-curing barn.

Figure 1D:
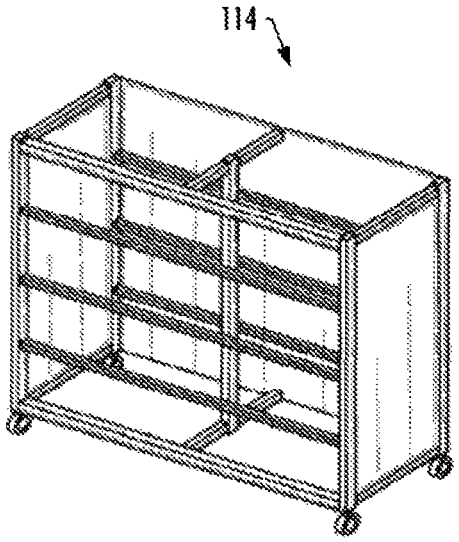
FIG. 1D illustrates a rack configured for use in the tobacco curing site of FIGS. 1A, 1B and 1C, according to an example implementation of the present disclosure.

The curing site 100 may include a curing mechanism (e.g., air-curing mechanism, fire-curing mechanism, or flue-curing mechanism such as a furnace) area 106 at one end (which may be partially or wholly external to the four walls in some barns) and a tobacco curing region 108 adjacent the curing mechanism area, and occupying at least a portion of the rest of the barn interior. In a typical bulk curing barn, the curing mechanism area and tobacco curing region may be separated from one another by a wall 110. The curing site may often include doors 112 at the curing region end of the barn in order to allow loading of tobacco to (and unloading of tobacco from) that barn, commonly in racks 114 having a plurality of laths therein that are packed with tobacco leaves in a particular manner. One example of a rack structure is shown in FIG. 1D. In some example implementations, bulk tobacco curing barns may be equipped with boxes rather than or in addition to racks.

Generally, the curing barn 100 may include an air intake damper 116 near its curing mechanism end, and an exhaust damper 118 near doors of its curing region end. Typically, the tobacco to be cured may be contained in the racks and/or boxes 114. The curing mechanism area 110 of the barn may include includes a curing mechanism 120 (e.g., a heat source such as a burner that may be fueled by a suitable fuel, such as liquid propane gas (LPG), fuel oil or the like), a curing mechanism (e.g., heat) exchange unit 122 (unless fire-curing is being used, although a heat exchanger may be used to pre-heat incoming air in certain fire-curing systems), and one or more air-directing means, implemented therein as fans 124*a*, 124*b*. In use, heated air in the region near the exchange unit may be forced in a chosen direction by the fan(s), and may be forced to flow into the tobacco curing region 108 of the barn via air flow passages. During "indirect heat curing" the air passing through the exchange unit may be heated, but may also be kept separate from the exhaust byproducts of the material being burned to generate the heat. A chimney or other exhaust vent or outlet 126 may be provided to exhaust certain combustion by-products from the curing mechanism (e.g., a heat-generation device such as a furnace).

The conditions of temperature to which the tobacco may be exposed during curing can vary. The time frame over which curing of the tobacco occurs also can vary. For the flue-curing of Virginia tobaccos, the temperature to which the tobacco is exposed typically is in the range of about 35° C. to about 75° C.; and the time over which the tobacco is exposed to those elevated temperatures usually is at least about 120 hours, but often may be less than about 200 hours. Curing temperatures as used herein may be air temperatures representative of the average air temperature within the curing barn during curing process steps. Average air temperatures may be taken at one or more points or locations within the curing barn that give an accurate indication of the temperature that the tobacco experiences during curing steps. For examples, Virginia tobacco first may be subjected to a yellowing treatment step whereby the tobacco is heated at about 35° C. to about 40° C. for about 24 to about 72 hours, often about 36 to about 60 hours; however, if desired, the yellowing step may be shortened. See, for example, U.S. Pat. No. 8,151,804 to Williams, which is incorporated herein by reference. The tobacco may then be subjected to a leaf drying treatment step whereby it is heated, for example, at about 40° C. to about 57° C. for about 48 hours; after which it is subjected to a midrib (i.e., stem) drying treatment step whereby it is heated, for example, at about 57° C. to about 75° C. for about 48 hours.

Thus, tobacco may be cured for a total period of about 5 days to about 8 days, often about 6 days to about 7 days. Temperatures to which the tobacco is exposed during cure typically will not exceed about 90° C., frequently will not exceed about 85° C., and preferably will not exceed about 80° C. Exposing Virginia tobacco to temperatures above about 70° C. to about 75° C. during curing may not be desirable, as exposure of the tobacco to exceedingly high temperatures, even for short periods of time, can have the effect of decreasing the quality of the cured tobacco. Typically, some ambient air preferably may be introduced into the barn during the yellowing stage, significantly more ambient air preferably is introduced into the barn during the leaf drying stage, and heated air preferably is recirculated within the barn during midrib drying stage. The relative humidity within the barn during curing varies, and is observed to change during curing. Typically, a relative humidity of about 85 percent may be maintained within the curing barn during the yellowing stage, but then may be observed and/or controlled to decrease steadily during leaf drying and midrib drying stages.

After the tobacco is exposed to curing conditions, the use of heating is stopped. Typically, the fresh air dampers/vents as well as the doors of the barn are opened in order to allow contact of ambient air with that tobacco. As such, moisture within the ambient air is allowed to moisten the tobacco; and the very dry freshly cured tobacco is rendered less brittle. Those of skill in the art will appreciate that tobacco curing of this type may be generally conducted in locations/climates with high relative humidity, which is exploited for this moistening effect. Additionally, the freshly cured tobacco may be moistened by spraying tobacco with a spray or mist of water. If desired, the tobacco may be moistened using high moisture-containing liquid. The cooled tobacco may then be taken down, and the tobacco may be removed from the curing barn.

Figure 2A:
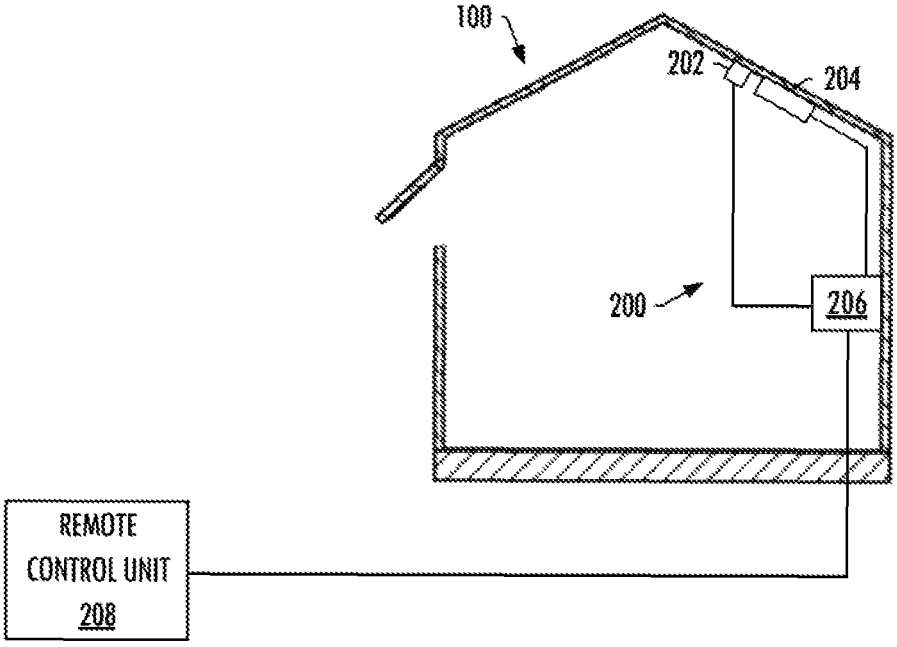
FIG. 2A illustrates a tobacco curing site having a system for monitoring the environmental conditions thereof, according to an example implementation of the present disclosure.

As previously indicated, the conditions of temperature or humidity to which tobacco may be exposed during curing can vary, and exposure of the tobacco to exceedingly high temperatures, even for short periods of time, can have the effect of decreasing the quality of the cured tobacco. Therefore, it may be desirable to monitor the conditions (e.g., temperature and humidity) within tobacco curing sites. Accordingly, FIG. 2A illustrates the tobacco curing site 100 of FIGS. 1A-1D having a system 200 therein for monitoring the environmental conditions thereof. The system may include a power supply 202, a temperature and humidity sensor 204 contained within the tobacco curing site and positioned proximate the tobacco, a local control unit 206 having a distal position relative the tobacco, and a remote control unit 208. In some examples, the housing of the tobacco curing site includes a pitched roof, and the temperature and humidity sensor may be positioned between an eave and peak thereof.

Figure 2B:
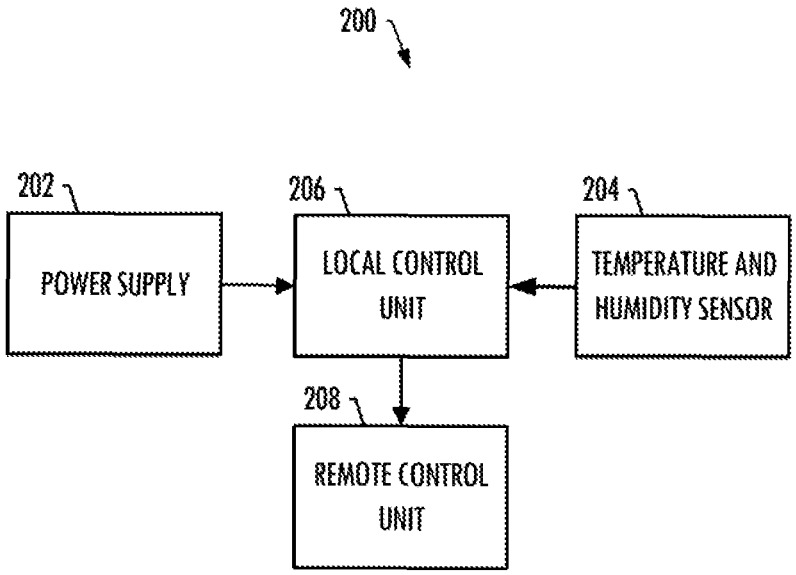
FIG. 2B illustrates the system of FIG. 2A according to an examples implementation of the present disclosure.

As shown in FIG. 2B, the local control unit 206 may be operatively coupled to the power supply 202, temperature and humidity sensor 204, and remote control unit 208. The power supply may include a supercapacitor generally configured to provide power, and a photovoltaic cell connected to and from which the supercapacitor is chargeable. The temperature and humidity sensor may be generally configured to measure a temperature or humidity of an environment within the tobacco curing site 100 (e.g., an environment within a housing of the tobacco curing site) as the tobacco is cured, and generate a signal corresponding to the temperature or humidity so measured. The local control unit may be powered by the power supply and generally configured to receive the signal from the temperature and humidity sensor and humidity, and wirelessly transmit corresponding measurement data to a remote control unit 208 for display or analysis.

As previously indicated, the local control unit 206 may be configured to receive the signal, generated by the temperature and humidity sensor 204, and generate corresponding measurement data. In some examples, the local control unit may be rated at a maximum operating temperature that is less than a temperature at which the tobacco is cured.

The local control unit 206 may also be configured to wirelessly transmit the corresponding measurement data to the remote control unit 208. The remote control unit may be configured to display the measurement data or a current condition of the housing determined based on an analysis of the measurement data. In these examples, the remote control unit may be configured to generate a log including the measurement data. The remote control unit may be further configured to timestamp each instance of the corresponding measurement data, and store the log including the timestamped measurement data in a local memory of the remote control unit, or in remote data storage communicably coupled to the remote control unit (e.g., cloud storage).

In some examples, the remote control unit 208 may be configured to display the measurement data, and in at least one instance, determine that the measurement data does not comply with a predefined specification of the curing site based on the analysis thereof, and generate a corresponding alert. In particular, the remote control unit may generate an alert in at least one instance in which the corresponding measurement data indicates that the temperature or humidity is outside a predefined specification of the curing site. In these examples, the system 200 may further comprise an alarm, and the local control unit 206 may be configured to receive the alert from the remote control unit, and activate the alarm in response thereto.

Figure 3:
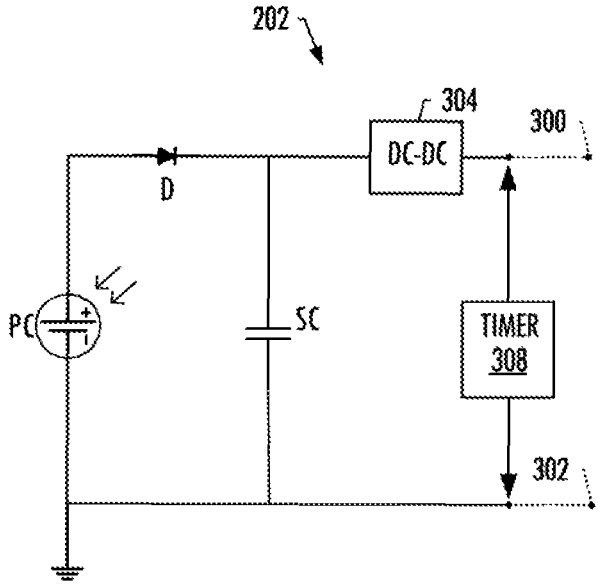
FIGS. 3 and 4 illustrate various elements of a power supply of the system of FIGS. 2A and 2B, according to various example implementations.
Figure 4:
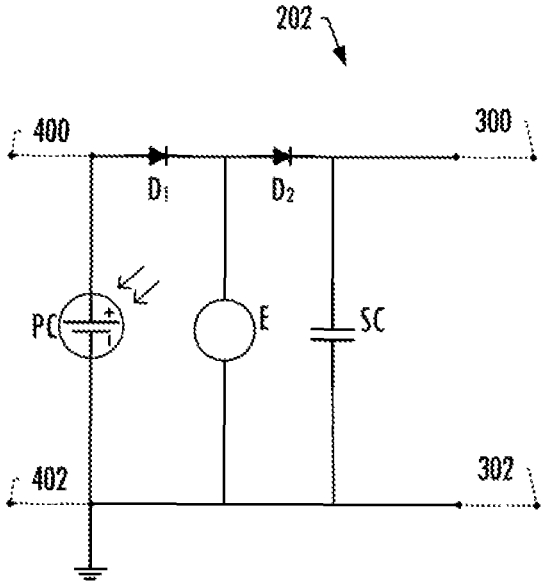

FIGS. 3 and 4 more particularly illustrate the power supply 202 of FIG. 2. As previously indicated, the power supply may include a supercapacitor SC and photovoltaic cell PC therein. In some examples, the power supply may include a plurality of supercapacitors connected in parallel for providing power to local control unit 206. The photovoltaic cell may be connected to the supercapacitor such that the supercapacitor is chargeable from the photovoltaic cell.

The supercapacitor SC may be any of a number of different types of supercapacitors, such as an electric double-layer capacitor (EDLC), a hybrid capacitor such as a lithium-ion capacitor (LIC), or the like. Supercapacitors such as EDLCs may be rated for a fast charge (e.g., three seconds). The supercapacitor be rated for a long lifetime (e.g., 32 years) and cycle life (e.g., 1,000,000 charge-discharge cycles), and provide an environmentally-friendly, lower-cost solution. The supercapacitor may provide high-current pulses to the electrical load. And as the supercapacitor does not include an electrolyte between the electrodes, the supercapacitor may therefore operate with only a negligible probability of a short circuit.

Hybrid capacitors such as the LIC generally have features of a battery (high voltage and high energy density), while maintaining the traditional characteristics of a capacitor of rapid charge (e.g., one hundred and fifty seconds). A hybrid capacitor may be rechargeable, and have the ability to operate on its own for a longer period without the need of another source of energy from which the hybrid capacitor may be chargeable. The hybrid capacitor may have a longer lifetime (e.g., 10 years) and cycle life as compared to other options, and is more environmentally friendly.

As previously indicated, the power supply 202, and more particularly, the supercapacitor SC may be configured to power the local control unit 206. As such, the power supply 202 may include terminals 300, 302 coupled to the supercapacitor and photovoltaic cell PC, and connectable with the local control unit for providing power thereto. The power supply may also include a number of electrical components, such as DC-to-DC converters, diodes, and the like, which may be coupled with the supercapacitor and photovoltaic cell to form an electrical circuit.

For example, the power supply 202 may include a diode D connected to the supercapacitor SC between the supercapacitor and photovoltaic cell PC. The diode may be configured to prevent a backflow of current into the photovoltaic cell during discharge. The power supply 202 may also include a DC-to-DC converter 304 connected to the supercapacitor SC between the supercapacitor and the terminals 300, 302. The DC-to-DC converter may be configured to regulate a discharge current from the supercapacitor to the local control unit 206. The DC-to-DC converter may avoid too fast discharge of the supercapacitor and it may facilitate a uniform dissipation of current so that the supercapacitor provides constant power to the power source. In some examples, the DC-to-DC converter may be adjustable, and in at least one instance, the DC-to-DC converter may be configured to increase a rate of the discharge current from the supercapacitor to the local control unit.

In some examples, the local control unit 206 may have an active mode and an inactive mode. In these examples, the system 200 may further comprise a power supply timer 308 operatively coupled to the power supply 202 and configured to decrease a current discharge rate thereof when the local control unit is in the inactive mode. In these examples implementations, one or more instances may trigger and/or cause the local control unit to operate within the inactive mode. The one or more instances may be or include exceeding a temperature threshold. For example, in an instance in which the temperature and humidity sensor 204 detects a temperature below a predefined threshold, the power supply and local control unit may enter an inactive mode (which may also be referred to as a sleep mode or quiescent mode) and may draw a lesser amount of current within a desired microamp (uA) range. When the temperature exceeds the predefined threshold the power supply and local control unit may resume operating within an active mode. In some example implementations, the active and inactive modes may operate based at least in part on a software graphical user interface (GUI) that may be programmed into the local control unit or remote control unit 208 and permanently stored therein.

The power supply 202 may also include one or more secondary sources of power for providing power to the local control unit 206. As shown in FIG. 4, in some examples, the power supply includes a source of energy E (e.g., secondary source or power or energy) configured to provide power. In these examples, the supercapacitor SC and secondary source of energy may be configured to switchably provide power to the local control unit 206. In one example implementation, the supercapacitor and secondary source of energy being configured to switchably provide power may include the supercapacitor being configured to initially provide power, and the power supply being configured to switch to the secondary source of energy to provide power only after the supercapacitor has discharged by at least a threshold amount.

The secondary source of energy E may be any of a number of different types, such as various power supplies configured to operate in a manner similar to a battery power supply. In other examples, the secondary source of energy may be or include a battery. For example, the secondary source of energy may be or include a solid-state battery, lithium-ion battery or the like. In these examples, the secondary source of energy may be fixed or removable from the power supply.

Examples of suitable solid-state batteries are STMicroelectronics' EnFilm™ rechargeable solid-state lithium thin-film batteries, which feature a $LiCoO_2$ cathode, LiPON ceramic electrolyte and a lithium anode. In particular, the EFL700A39 battery from STMicroelectronics has a nominal voltage of 4.1V and thickness of only 220 um. The battery is rated for a 10-year life time, and a 4000 charge-discharge cycle life. The battery also has a relatively short typical charge, in some instances charging in approximately ten (10) minutes. The battery has a ceramic electrolyte, which may produce currents by movements of electrons and thus reduce the risk of undesirable dendrite growth in the cathode and anode that may otherwise lead to a short circuit.

In some examples and in particular those in which the secondary source of energy E is or includes a battery, the supercapacitor SC may smooth fluctuating power from a low-current source when the source of energy weakens, and may thereby increase its lifetime and cycle life. In examples with a lithium-ion battery, the supercapacitor may operate over a larger range of temperatures (e.g., from −50 to 70° C.) than the lithium-ion battery, and may turn on at cold temperatures (e.g., below −10° C.) and high temperatures (e.g., above 40° C.) when the lithium-ion battery may otherwise fail to start. In these examples, the supercapacitor may therefore provide additional benefits in colder and warmer regions.

Similar to the supercapacitor SC, the secondary source of energy E may also be connected with, and thereby chargeable from the photovoltaic cell PC. Accordingly, the number of other electrical components may also be coupled with the secondary source of power to further form the electrical circuit of the power supply 202. For example, the power supply 202 may include a plurality of diodes (e.g., $D_1$ and $D_2$) connected to the photovoltaic cell PC between the photovoltaic cell and the supercapacitor and secondary source of energy. The diodes may be configured to prevent a backflow of current into the photovoltaic cell during discharge.

In some examples, the secondary source of energy E may also be connected with, and chargeable from a source of energy other than the photovoltaic cell. In these examples, the power supply may include terminals 400, 402 connectable with an external source of energy from which the secondary energy source may be chargeable. The terminals may also be connectable with the external source of energy for charging the supercapacitor. In some example implementations, the terminals may be connectable with a wall power supply, portable power supply.

The foregoing description of use of the article(s) may be applied to the various example implementations described herein through minor modifications, which may be apparent to the person of skill in the art in light of the further disclosure provided herein. The above description of use, however, is not intended to limit the use of the article but is provided to comply with all necessary requirements of disclosure of the present disclosure. Any of the elements shown in the article(s) illustrated in FIGS. 1-4 or as otherwise described above may be included in an aerosol delivery device according to the present disclosure.

Many modifications and other implementations of the disclosure set forth herein will come to mind to one skilled in the art to which this disclosure pertains having the benefit of the teachings presented in the foregoing descriptions and the associated drawings. Therefore, it is to be understood that the disclosure is not to be limited to the specific implementations disclosed, and that modifications and other implementations are intended to be included within the scope of the appended claims. Moreover, although the foregoing descriptions and the associated drawings describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A tobacco curing site comprising:

a housing;

a plurality of laths contained within the housing and configured to carry tobacco;

a curing mechanism contained within the housing and configured to cure the tobacco carried by the plurality of laths; and a system for monitoring an environmental condition of the tobacco, the system comprising:

a temperature and humidity sensor contained within the housing, positioned proximate the tobacco, and configured to measure a temperature or humidity of an environment within the housing as the tobacco is cured, the temperature and humidity sensor being configured to generate a signal corresponding to the temperature or humidity so measured;

a power supply including a supercapacitor configured to provide power, and a photovoltaic cell connected to and from which the supercapacitor is chargeable; and a local control unit having a distal position relative to the tobacco, operatively coupled to the temperature and humidity sensor, and powered by power supply, the local control unit being configured to receive the signal from the temperature and humidity sensor, and wirelessly transmit corresponding measurement data to a remote control unit for display or analysis.

2. The tobacco curing site of claim 1, wherein the curing mechanism includes at least one of an air-curing mechanism, fire-curing mechanism, or flue-curing mechanism.

3. The tobacco curing site of claim 1, wherein the housing includes a pitched roof, and the temperature and humidity sensor is positioned between an eave and peak thereof.

4. The tobacco curing site of claim 1, wherein the power supply further includes a secondary power source configured to provide power, and the local control unit is switchably powered by the supercapacitor or secondary power source.

5. The tobacco curing site of claim 1, wherein the local control unit is rated at a maximum operating temperature that is less than a temperature at which the tobacco is cured.

6. The tobacco curing site of claim 1, wherein the power supply further includes a DC-to-DC converter connected to the supercapacitor, between the supercapacitor and local control unit, and configured to regulate a discharge current from the power supply to the local control unit.

7. The tobacco curing site of claim 1, wherein the local control unit has an active mode and an inactive mode, and the system further comprises a power supply timer operatively coupled to the power supply and configured to decrease a current discharge rate thereof when the local control unit is in the inactive mode, in at least one instance the inactive mode being triggered by the temperature so measured being below a predefined threshold.

8. The tobacco curing site of claim 1, wherein the local control unit is configured to wirelessly transmit the corresponding measurement data to the remote control unit configured to generate a log including the measurement data.

9. The tobacco curing site of claim 8, wherein the local control unit is configured to wirelessly transmit the corresponding measurement data to the remote control unit configured to timestamp each instance of the corresponding measurement data, and store the log including the timestamped measurement data in a local memory of the remote control unit, or in remote data storage communicably coupled to the remote control unit.

10. The tobacco curing site of claim 1, wherein the local control unit is configured to wirelessly transmit the corresponding measurement data to the remote control unit configured to generate an alert in at least one instance in which the corresponding measurement data indicates that the temperature or humidity is outside a predefined specification of the curing site.

11. The tobacco curing site of claim 10, wherein the system further comprises an alarm, and the local control unit is configured to receive the alert from the remote control unit, and activate the alarm in response thereto.

12. A system for monitoring environmental conditions of a tobacco curing site within which tobacco is cured, the system comprising:

a power supply including a supercapacitor configured to provide power, and a photovoltaic cell connected to and from which the supercapacitor is chargeable;

a temperature and humidity sensor contained within the tobacco curing site, positioned proximate the tobacco, and configured to measure a temperature or humidity of an environment within the tobacco curing site as the tobacco is cured, the temperature and humidity sensor being configured to generate a signal corresponding to the temperature or humidity so measured;

a local control unit having a distal position relative to the tobacco, operatively coupled to the temperature and humidity sensor, and powered by power supply, the local control unit being configured to receive the signal from the temperature and humidity sensor, and wirelessly transmit corresponding measurement data to a remote control unit for display or analysis.

13. The system of claim 12, wherein the power supply further includes a secondary power source configured to provide power, and the local control unit is switchably powered by the supercapacitor or secondary power source.

14. The system of claim 12, wherein the local control unit is rated at a maximum operating temperature that is less than a temperature at which the tobacco is cured.

15. The system of claim 12, wherein the power supply further includes a DC-to-DC converter connected to the supercapacitor, between the supercapacitor and local control unit, and configured to regulate a discharge current from the power supply to the local control unit.

16. The system of claim 12, wherein the local control unit has an active mode and an inactive mode, and the system further comprises a power supply timer operatively coupled to the power supply and configured to decrease a current discharge rate thereof when the local control unit is in the inactive mode, in at least one instance the inactive mode being triggered by the temperature so measured being below a predefined threshold.

17. The system of claim 12, wherein the local control unit is configured to wirelessly transmit the corresponding measurement data to the remote control unit configured to generate a log including the measurement data.

18. The system of claim 17, wherein the local control unit is configured to wirelessly transmit the corresponding measurement data to the remote control unit configured to timestamp each instance of the corresponding measurement data, and store the log including the timestamped measurement data in a local memory of the remote control unit, or in remote data storage communicably coupled to the remote control unit.

19. The system of claim 12, wherein the local control unit is configured to wirelessly transmit the corresponding measurement data to the remote control unit configured to generate an alert in at least one instance in which the corresponding measurement data indicates that the temperature or humidity is outside a predefined specification of the curing site.

20. The system of claim 19, wherein the system further comprises an alarm, and the local control unit is configured to receive the corresponding alert from the remote control unit, and activate the alarm in response thereto.

* * * * *